US011441214B2

(12) United States Patent
Ye et al.

(10) Patent No.: US 11,441,214 B2
(45) Date of Patent: Sep. 13, 2022

(54) LOW-YIELD-RATIO ULTRA-HIGH-STRENGTH HIGH-TOUGHNESS STEEL FOR PRESSURE HULLS AND PREPARATION METHOD THEREFOR

(71) Applicant: NORTHEASTERN UNIVERSITY, Liaoning (CN)

(72) Inventors: Qibin Ye, Liaoning (CN); Liye Kan, Liaoning (CN); Cheng Zhou, Liaoning (CN); Qinghai Wang, Liaoning (CN); Yimin Wang, Liaoning (CN); Yong Tian, Liaoning (CN); Zhaodong Wang, Liaoning (CN)

(73) Assignee: NORTHEASTERN UNIVERSITY, Liaoning (CN)

( * ) Notice: Subject to any disclaimer, the term of this patent is extended or adjusted under 35 U.S.C. 154(b) by 57 days.

(21) Appl. No.: 17/130,785

(22) Filed: Dec. 22, 2020

(65) Prior Publication Data

US 2022/0002849 A1 Jan. 6, 2022

(30) Foreign Application Priority Data

Jul. 1, 2020 (CN) ..... 202010620788.1

(51) Int. Cl.
*C22C 38/46* (2006.01)
*C22C 38/42* (2006.01)
(Continued)

(52) U.S. Cl.
CPC ..... *C22C 38/46* (2013.01); *C21D 8/005* (2013.01); *C21D 8/0226* (2013.01); *C21D 9/46* (2013.01); *C22C 38/02* (2013.01); *C22C 38/04* (2013.01); *C22C 38/42* (2013.01); *C22C 38/44* (2013.01); *C21D 2211/001* (2013.01); *C21D 2211/005* (2013.01); *C21D 2211/008* (2013.01)

(58) Field of Classification Search
None
See application file for complete search history.

(56) References Cited

FOREIGN PATENT DOCUMENTS

CN 101481779 A * 7/2009
CN 107312974 A 11/2017
(Continued)

*Primary Examiner* — Anthony M Liang
(74) *Attorney, Agent, or Firm* — Muncy, Geissler, Olds & Lowe, P.C.

(57) ABSTRACT

The present invention discloses a low-yield-ratio ultra-high-strength high-toughness steel for pressure hulls and a preparation method therefor, wherein the chemical components by weight percentage are: 0.05%-0.10% of C, 0.15%-0.35% of Si, 0.60%-1.00% of Mn, 0.10%-0.50% of Cu, 0.10%-1.00% of Mo, 0.40%-0.70% of Cr, 0.05%-0.15% of V, 5.00%-10.00% of Ni, and the balance of Fe and unavoidable impurities. The technical solution of the present invention adopts secondary quenching heat treatment, the first quenching is performed to achieve complete austenitizing, and then the second quenching and tempering are performed to finally obtain complex phase structures such as tempered martensite, critical ferrite and retained austenite, so as to meet the performance index requirements of low yield ratio, ultra-high strength and high toughness, and thereby promoting application in practice.

1 Claim, 2 Drawing Sheets

(51) Int. Cl.

| | |
|---|---|
| ***C22C 38/44*** | (2006.01) |
| ***C22C 38/02*** | (2006.01) |
| ***C22C 38/04*** | (2006.01) |
| ***C21D 8/02*** | (2006.01) |
| ***C21D 8/00*** | (2006.01) |
| ***C21D 9/46*** | (2006.01) |

(56) References Cited

FOREIGN PATENT DOCUMENTS

| | | | | | |
|---|---|---|---|---|---|
| EP | 3674426 | A1 * | 7/2020 | ..... | C21D 1/19 |
| WO | WO-2019039339 | A1 * | 2/2019 | ..... | C21D 1/19 |

* cited by examiner (a) (b) (c)

LOW-YIELD-RATIO ULTRA-HIGH-STRENGTH HIGH-TOUGHNESS STEEL FOR PRESSURE HULLS AND PREPARATION METHOD THEREFOR

TECHNICAL FIELD

The present invention belongs to the field of ferrous materials, which relates to a low-yield-ratio ultra-high-strength high-toughness steel with a high toughness, and particularly to a low-yield-ratio (≤0.9) ultra-high-strength high-toughness steel for pressure hulls.

BACKGROUND

A steel for submarine pressure hulls is an important structural material for constructing ship hulls. With the continuous improvement of requirements on submarine combat technical performance, higher requirements are put forward for the performance of the steel for submarine pressure hulls. A submarine generally sails and fights in an environment with an underwater temperature of −2.2° C.-28.8° C. and a water surface temperature of −34° C.-49° C. The floating and submergence of the submarine during service make a hull bear a periodical alternating load, and the hull may also be attacked by an enemy anti-submarine weapon. Therefore, the material of a pressure hull is required to have high strength-to-weight ratio (ratio of yield point to density), high toughness, and good welding performance. The patents with the publication number of CN101481779A and CN107312974A both disclose steels for high-performance low-alloy hulls, and the carbon contents thereof respectively reach 0.15-0.30% and 0.28-0.35%. Because carbon has a strong solution strengthening effect, carbon is a key element for obtaining an ultra-high strength. However, with the increase of carbon content, the welding crack sensitivity of an ultra-high-strength steel increases, and the tendency of welding cold cracking is great. Therefore, the preheating temperature and welding process parameters need to be strictly controlled during a welding process, which will lead to a prolonged construction period and an increased manufacturing cost.

At present, a Ni—Cr—Mo—V alloy system is mainly used in the ultra-high-strength high-toughness steel for pressure hulls with a yield strength of 890 MPa and above to achieve grain refinement and enhance the effects of solution strengthening and precipitation strengthening, thereby improving the performance of the steel. In order to improve the weldability of the steel, it is necessary to reduce the C element content of the steel and increase the Ni element content to ensure the strength and hardenability of this type of steel. With the continuous development of submarine construction technology, the requirements for the use of the ultra-high-strength high-toughness steel for pressure hulls are also increasing; not only a relatively high strength is required, and the performance requirements such as plastic toughness and yield ratio are also becoming increasingly stringent. Therefore, through the use of new heat treatment processes and the development of complex phase structure control technologies, the Ni—Cr—Mo—V alloy system plays a very important role in the research and application of the ultra-high-strength steel for hull structures. A "quenching+tempering" heat treatment process is often used for the Ni—Cr—Mo—V alloy system ultra-high-strength steel for hull structures; through this process, a high-strength tempered martensite lath matrix can be obtained, and nanometer level carbide particles are distributed on the matrix. This heat treatment method can effectively improve the strength and impact toughness of the ultra-high-strength steel for hull structures. However, the yield ratio of a sample treated by the "quenching+tempering" process is too high, which is usually higher than 0.95. Yield ratio is the ratio of the yield strength to the tensile strength of a material, which is a parameter characterizing the plasticity of the material. With respect to the steel for hull structures, the higher the yield ratio is, the smaller the plastic range from yielding to fracture will be, and therefore the greater the risk of fracture will be.

SUMMARY

The purposes of the present invention are to overcome the defects in the prior art, provide an ultra-high-strength high-toughness steel for pressure hulls with a yield strength of higher than 890 MPa and a yield ratio of lower than 0.9 and a preparation method therefor in view of the problems existing in the ultra-high-strength high-toughness steel for pressure hulls, and provide a low-yield-ratio (≤0.9) Ni—Cr—Mo—V system ultra-high-strength high-toughness steel for pressure hulls with a yield strength of 890 level. The ultra-high-strength steel involved has ultra-high strength, excellent plasticity and high low-temperature toughness.

The technical purposes of the present invention are realized by the following technical solution:

A preparation method for a low-yield-ratio ultra-high-strength high-toughness steel for pressure hulls, comprising the following steps:

Step 1, Melting

Melting to obtain a casting blank using the following chemical components by weight percentage: 0.05%-0.10% of C, 0.15%-0.35% of Si, 0.60%-1.00% of Mn, 0.10%-0.50% of Cu, 0.10%-1.00% of Mo, 0.40%-0.70% of Cr, 0.05%-0.15% of V, 5.00%-10.00% of Ni, and the balance of Fe and unavoidable impurities.

Step 2, Hot Rolling

Keeping the casting blank obtained in step 1 at 1150° C.-1220° C. for soaking, and then performing hot rolling; the hot rolling adopts a two-stage rolling process; the rolling temperature of the first stage is 1150° C.-1000° C., and the reduction is ≥50%; the rolling temperature of the second stage is 900° C.-750° C., and the reduction is ≥50%; the final rolling thickness is 5-80 mm; and air cooling a hot-rolled high-temperature steel plate to room temperature;

Step 3, Heat Treatment

Heating a sample of the hot-rolled steel plate in step 2 to 790° C.-810° C., soaking for 20-40 minutes, and water quenching to room temperature; then heating again to 650° C.-690° C., soaking for 20-40 minutes, and water quenching to room temperature; and finally, tempering at 590° C.-610° C. for 50-70 minutes.

In the above technical solution, the chemical components of the low-yield-ratio high-strength high-toughness steel for pressure hulls are characterized by a low carbon Ni—Cr—Mo—V alloy system; and the chemical components by weight percentage are: 0.05%-0.10% of C, 0.15%-0.35% of Si, 0.60%-1.00% of Mn, 0.10%-0.50% of Cu, 0.10%-1.00% of Mo, 0.40%-0.70% of Cr, 0.05%-0.15% of V, 5.00%-10.00% of Ni, and the balance of Fe and unavoidable impurities.

In the above technical solution, the microstructure of the low-yield-ratio high-strength high-toughness steel for pressure hulls includes complex phase structures such as tempered martensite, critical ferrite and retained austenite, and a matrix thereof contains a large number of nanometer scale precipitation strengthening phases, so as to meet the performance index requirements of low yield ratio and ultra-high strength. At the same time, the volume fraction of retained austenite is ≥10%.

In the above technical solution, the low-yield-ratio high-strength high-toughness steel for pressure hulls has a yield strength $R_p0.2$ of ≥890 MPa, which can reach 910-950 MPa; a tensile strength $R_m$ of ≥1050 MPa; an elongation after breaking of ≥15%; a yield ratio of ≤0.9; an excellent strong plastic matching performance; a −84° C. impact energy of ≥200 J, which can reach 210-230 J; and a −196° C. impact energy of ≥84 J, which can reach 85-90 J.

In the above technical solution, when secondary quenching treatment is performed, the heat treatment time is 20-40 minutes; and the heat treatment temperature is 650° C.-690° C. When tempering treatment is performed, the tempering heat treatment time is 50-70 minutes; and the tempering temperature is 590° C.-610° C. The effect of the secondary quenching+tempering heat treatment is to form ≥10% of retained austenite in the steel to reduce the yield ratio, and at the same time precipitate a large number of nanometer strengthening phases to greatly improve the strength.

The selection and content setting of the chemical components of the low-yield-ratio high-strength high-toughness steel for pressure hulls of the present invention are based on the following:

Carbon: an important strengthening element of the ultra-high-strength steel, which can significantly improve the hardenability of the steel. However, a high carbon content will deteriorate the weldability of the steel, which is not conducive to the subsequent use in the present invention. In order to improve the weldability, plasticity and toughness of the ultra-high-strength steel, and to ensure ultra-high strength, the content of carbon is set to the range of 0.05%-0.10%.

Silicon: a strengthening element of the steel, but will also reduce the surface quality of the steel. Therefore, in the present invention, silicon is limited to the range of 0.15%-0.35%.

Manganese: a stable austenitizing element, which can improve the hardenability of the steel, and play a role in solution strengthening and grain refinement. In the present invention, the content of manganese is 0.60%-1.00%.

Chromium and molybdenum: hardenability elements, which can increase the strength and hardness of the steel and prevent temper brittleness. In the present invention, the contents of chromium and molybdenum are respectively 0.40%-0.70% and 0.10%-1.00%.

Nickel: a strong hardenability and austenite stabilizing element, which can improve the strength of the steel on the one hand, and improve the low-temperature toughness on the other hand. For an ultra-high-strength steel containing copper element, the addition of nickel can avoid temper brittleness. In the present invention, the content of nickel is 5.00%-10%.

Vanadium: an important carbide forming element in the steel, which can form nanometer level precipitation particles during tempering treatment to improve the strength of the steel. In the present invention, the content of vanadium is 0.05%-0.15%.

Compared with the prior art, the present invention has the following beneficial effects:

The low-yield-ratio high-strength high-toughness steel for pressure hulls of the present invention has the yield strength of higher than 890 MPa, the elongation after breaking of greater than 15%, the yield ratio of ≤0.9, the −84° C. impact energy of ≥200 J, and the −196° C. impact energy of ≥84 J; and has ultra-high strength, excellent plasticity, and excellent low-temperature impact toughness.

The low-yield-ratio high-strength high-toughness steel for pressure hulls of the present invention adopts tempered martensite, critical ferrite and retained austenite in structure, uses nanometer strengthening phases to obtain the ultra-high strength, and adopts a low carbon content design with a carbon content of only 0.05%-0.10%, therefore, the steel has an excellent weldability while maintaining the ultra-high strength.

DETAILED DESCRIPTION

Figure 1:
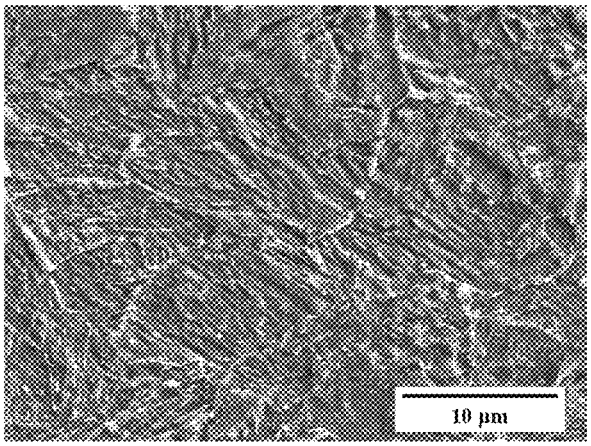
FIG. 1 is a scanned structure photograph of a sample treated by a conventional "quenching+tempering" process (quenching after soaking at 800° C. for 30 minutes+tempering at 600° C. for 60 minutes) in the prior art.
Figure 2:
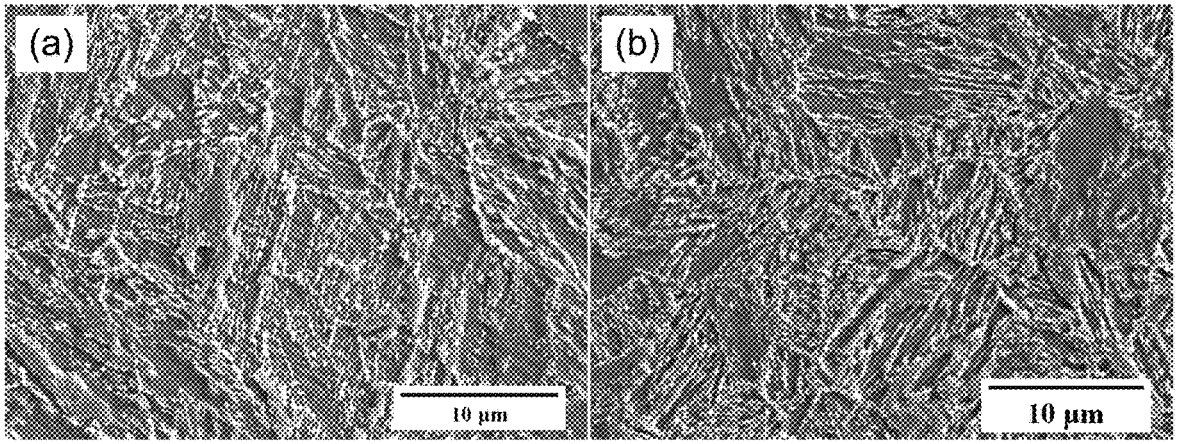
FIG. 2 is a scanning structure photograph of a sample at different secondary quenching temperatures in a technical solution of the present invention, wherein (a) the secondary quenching temperature is 655° C., and (b) the secondary quenching temperature is 680° C.
Figure 3:
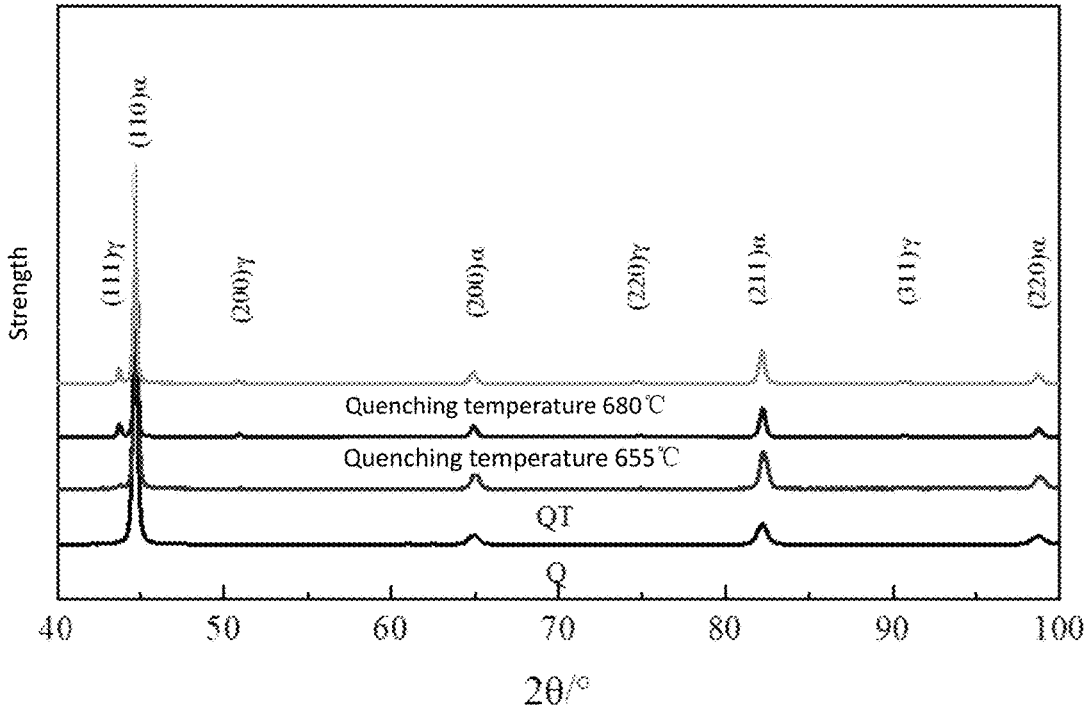
FIG. 3 is an XRD detection result of a low-yield-ratio high-strength high-toughness steel for pressure hulls at different secondary quenching temperatures in a technical solution of the present invention.
Figure 4:
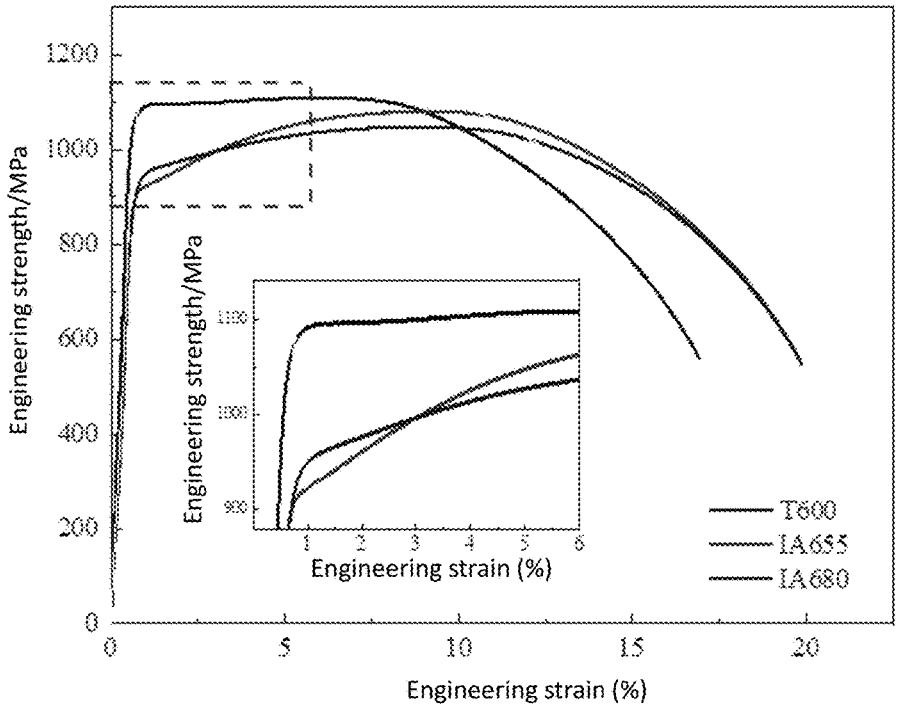
FIG. 4 is a room temperature tensile curve of a low-yield-ratio high-strength high-toughness steel for pressure hulls at different secondary quenching temperatures in a technical solution of the present invention.
Figure 5:
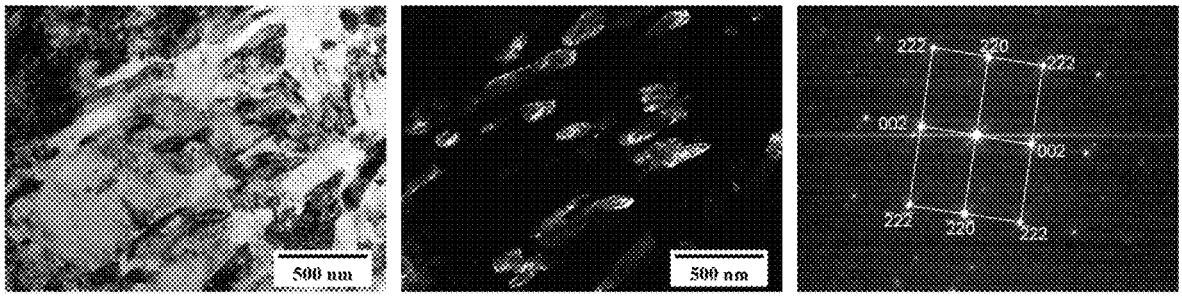
FIG. 5 is a high-power transmission electron microstructure photograph of a low-yield-ratio high-strength high-toughness steel for pressure hulls in embodiment 2 of the present invention, wherein (a) is a bright field image, (b) is a dark field image, and (c) is a diffraction spectrum of retained austenite.

The technical solution of the present invention is further described below in combination with the specific embodiments. The following performance test related standards are used for testing: (1) tension: GB/T 228.1-2010 Metallic materials—Tensile testing—Part 1: Method of test at room temperature; (2) impact: GB/T 229-2007 Metallic materials—Charpy pendulum impact test method; (3) yield ratio: the ratio of the yield strength to the tensile strength, wherein the test methods of the yield strength and the tensile strength are given by GB/T 228.1-2010. Metallographic characterization is performed using a ULTRA55 field emission scanning microscope from Zeiss, Germany. Phase analysis is performed using an X-ray diffractometer from Bruker AXS GmbH, Germany.

Embodiment 1

A low-yield-ratio (≤0.9) high-strength high-toughness steel for pressure hulls, wherein a molten steel is prepared according to the set components and cast into a casting blank, and the components by weight percentage are: 0.085% of C, 0.25% of Si, 0.75% of Mn, 0.50% of Mo, 0.6% of Cr, 07.20% of Ni, 0.12% of V, and the balance of Fe and unavoidable impurities.

The casting blank is heated to 1200° C. and soaked for 3 hours, and then two-stage hot rolling is performed; the rolling temperature of the first stage is 1150° C.-1000° C., and the reduction is 50%; the rolling temperature of the second stage is 920° C.-750° C., and the reduction is 50%; a steel plate is finally hot rolled to 12.5 mm; and the hot-rolled high-temperature steel plate is air cooled to room temperature. A sample of the hot-rolled steel plate is heated to 800° C., soaked for 30 minutes, and water quenched to room temperature; then heated again to 655° C., soaked for 30 minutes, and water quenched to room temperature; and finally tempered at 600° C. for 60 minutes.

By using the above preparation method, the yield strength $R_p0.2$ of 915 MPa, the tensile strength $R_m$ of 1080 MPa, the elongation after breaking of 20%, the yield ratio of 0.85, and the −84° C. impact energy of 220 J are obtained.

Embodiment 2

A low-yield-ratio (≤0.9) high-strength high-toughness steel for pressure hulls, wherein a molten steel is prepared according to the set components and cast into a casting blank, and the components by weight percentage are: 0.085% of C, 0.25% of Si, 0.75% of Mn, 0.50% of Mo, 0.6% of Cr, 7.20% of Ni, 0.12% of V, and the balance of Fe and unavoidable impurities.

The casting blank is heated to 1200° C. and soaked for 3 hours, and then two-stage hot rolling is performed; the rolling temperature of the first stage is 1150° C.-1000° C., and the reduction is 50%; the rolling temperature of the second stage is 920° C.-750° C., and the reduction is 50%; a steel plate is finally hot rolled to 12.5 mm; and the hot-rolled high-temperature steel plate is air cooled to room temperature. A sample of the hot-rolled steel plate is heated to 800° C., soaked for 30 minutes, and water quenched to room temperature; then heated again to 680° C., soaked for 30 minutes, and water quenched to room temperature; and finally tempered at 600° C. for 60 minutes.

By using the above preparation method, the yield strength $R_p0.2$ of 930 MPa, the tensile strength Rm of 1050 MPa, the elongation after breaking of 20%, the yield ratio of 0.88, the −84° C. impact energy of 235 J, and the −196° C. impact energy of 88 J are obtained.

The low-yield-ratio ultra-high-strength steel for hull structures of the present invention can be prepared by adjusting process parameters and component contents according to the contents of the present invention, and exhibits a performance basically consistent with that of the present invention. The above exemplarily describes the present invention. It shall be noted that any simple variation, amendment or equivalent replacement that can be made by those skilled in the art without contributing creative work on the premise of not departing from the core of the present invention shall be included in the protection scope of the present invention.

The invention claimed is:

1. A preparation method for a steel for pressure hulls, comprising the following steps:

step 1, melting melting to obtain a casting blank using the following chemical components by weight percentage: 0.05%-0.10% of C, 0.15%-0.35% of Si, 0.60%-1.00% of Mn, 0.10%-0.50% of Cu, 0.10%-1.00% of Mo, 0.40%-0.70% of Cr, 0.05%-0.15% of V, 5.00%-10.00% of Ni, and the balance of Fe and unavoidable impurities, step 2, hot rolling keeping the casting blank obtained in step 1 at 1150° C.-1220° C. for soaking, and then performing hot rolling to a final thickness of 5-80 mm to obtain a hot-rolled steel plate; wherein the hot rolling comprises a two-stage rolling process, wherein a first stage of the two-stage rolling process is carried out at a rolling temperature of 1000° C.-1150° C. and a reduction of >50%, and wherein a second stage of the two-stage rolling process is carried out at a rolling temperature of 750° C.-900° C. and a reduction of >50%; and air cooling the hot-rolled steel plate after the hot rolling to room temperature;

step 3, heat treatment heating a sample of the hot-rolled steel plate in step 2 to 790° C.-810° C., soaking for 20-40 minutes, and water quenching to room temperature; then heating again to 650° C.-690° C., soaking for 20-40 minutes, and water quenching to room temperature; and finally, tempering at 590° C.-610° C. for 50-70 minutes.

* * * * *